US008469676B2

(12) United States Patent
Sutherland

(10) Patent No.: US 8,469,676 B2
(45) Date of Patent: Jun. 25, 2013

(54) THERMAL HYDROGEN COMPRESSOR

(75) Inventor: Ian J. Sutherland, Grosse Pointe, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 434 days.

(21) Appl. No.: 12/844,664

(22) Filed: Jul. 27, 2010

(65) Prior Publication Data

US 2012/0028140 A1 Feb. 2, 2012

(51) Int. Cl.
*F04B 19/24* (2006.01)
*H01M 8/04* (2006.01)

(52) U.S. Cl.
USPC ..... 417/207; 429/435

(58) Field of Classification Search
USPC ..... 417/207, 208; 429/435, 446
See application file for complete search history.

(56) References Cited

U.S. PATENT DOCUMENTS

| | | | | |
|---|---|---|---|---|
| 3,195,806 | A * | 7/1965 | Bowen et al. | 417/52 |
| 4,028,008 | A * | 6/1977 | Shelton | 417/52 |
| 4,281,969 | A | 8/1981 | Doub, Jr. | |
| 4,402,187 | A | 9/1983 | Golben et al. | |
| 6,869,273 | B2 * | 3/2005 | Crivelli | 417/53 |
| 2004/0042957 | A1 * | 3/2004 | Martin | 423/644 |
| 2004/0179946 | A1 * | 9/2004 | Gianchandani et al. | 417/207 |

FOREIGN PATENT DOCUMENTS

| | | |
|---|---|---|
| DE | 859 743 | 12/1952 |
| DE | 100 37 163 A1 | 1/2002 |

* cited by examiner

*Primary Examiner* — Charles Freay
(74) *Attorney, Agent, or Firm* — John A. Miller; Miller IP Group, PLC

(57) ABSTRACT

A compressor for compressing a gas. The compressor receives the gas at a base pressure from a source and provides the gas at a higher pressure to a target. The compressor includes a series of pressure vessels and a one-way valve between the vessels, where a first pressure vessel is coupled to the source and a last pressure vessel is coupled to the target. For one period of time, every other pressure vessel in the series is heated starting with the pressure vessel coupled to the source. As the pressure in the heated pressure vessels increases as a result of the heat, the gas is sent to a next pressure vessel in the series of pressure vessels. After some period of time, the other alternating sequence of pressure vessels is heated to move the gas along the series of pressure vessels from the source to the target.

20 Claims, 2 Drawing Sheets

THERMAL HYDROGEN COMPRESSOR

BACKGROUND OF THE INVENTION

1. Field of the Invention

This invention relates generally to a compressor that increases the pressure of a gas delivered from a source to a target and, more particularly, to a thermal hydrogen compressor that increases the pressure of hydrogen gas delivered from a hydrogen source to a high pressure tank, where the compressor includes a series of pressure vessels that are selectively heated and cooled in a manner that causes the gas to flow from the source to the tank through the pressure vessels with an increasing pressure from pressure vessel to pressure vessel in the series.

2. Discussion of the Related Art

Hydrogen is a very attractive fuel because it is clean and can be used to efficiently produce electricity in a fuel cell. A hydrogen fuel cell is an electro-chemical device that includes an anode and a cathode with an electrolyte therebetween. The anode receives hydrogen gas and the cathode receives oxygen or air. The hydrogen gas is dissociated in the anode to generate free protons and electrons. The protons pass through the electrolyte to the cathode. The protons react with the oxygen and the electrons in the cathode to generate water. The electrons from the anode cannot pass through the electrolyte, and thus are directed through a load to perform work before being sent to the cathode. The work acts to operate the vehicle.

Typically hydrogen is stored in a compressed gas tank under high pressure on the vehicle to provide the hydrogen necessary for the fuel cell system. The pressure in the compressed tank can be upwards of 700 bar (70 MPa). In one known design, the compressed tank includes an inner plastic liner that provides a gas tight seal for the hydrogen, and an outer carbon fiber composite layer that provides the structural integrity of the tank. Because hydrogen is a very light and diffusive gas, the inner liner and the tank connector components, such as O-rings, must be carefully engineered in order to prevent leaks. The hydrogen is removed from the tank through a pipe. At least one pressure regulator is typically provided that reduces the pressure of the hydrogen within the tank to a pressure suitable for the fuel cell system.

A network of refueling stations will need to be provided as fuel cell vehicles become more popular and commercially available. Such a network of refueling stations will initially be provided in a limited manner, where urban centers will probably be the first to get such refueling stations and the number of fueling stations will expand from there. Because of this limited number of refueling stations, it has been proposed that a home fueling appliance be provided that generates hydrogen gas, and provides the hydrogen gas to the vehicle storage tanks at high pressure. The home fueling appliance can be used to top off the fuel storage system so that the consumer starts every morning with a full tank of hydrogen. Such home fueling appliance will need to be relatively inexpensive and be of a reasonable size.

Commercially available electrolyzers can be used to break water into its hydrogen and oxygen components, where the oxygen will typically be discarded. State of the art electrolyzers are typically able to provide hydrogen gas at a pressure up to 2000 PSI (13.5 MPa). Because of various issues related to hydrogen and oxygen being a combustible mixture, there are limits as to the amount of pressure that an electrolyzer can ultimately generate, which is far less than 10,000 PSI (70 MPa), which is the settled pressure of the fuel cell tank at 15°. These issues include hydrogen purity when high-pressure oxygen is contained in the system and hydrogen cross-over problems through membranes used to separate the gases.

Most of the energy expended when compressing a gas is on a low end of the pressure ramp. This is because the energy verses pressure relationship is a $\log_2$ relationship. For example, the theoretical energy needed to compress hydrogen from atmosphere to 70 MPa at 15° C. is 2.01 kWh/kg, and the theoretical energy needed to compress hydrogen to 13.5 MPa at 15° C. is 1.48 kWh/kg. At 13.5 MPa, 74% of the 70 MPa compression work is already done and only 0.53 kWh/kg of the theoretical work is left to be performed. The energy requirement to electrolyze hydrogen is typically 50-60 kWh/kg. 40 kWh/kg is the theoretical limit, so significant improvement in this value is unlikely. Because state-of-the-art electrolyzers can provide hydrogen at about 13.5 MPa, most of the work necessary to get the hydrogen from atmospheric pressure to 70 MPa has already been done at the outlet of the electrolyzer.

SUMMARY OF THE INVENTION

In accordance with the teachings of the present invention, a compressor is disclosed that is applicable to compress hydrogen gas. The compressor receives the gas at a base pressure from a source and provides the gas at a high pressure to a target. The compressor includes a series of pressure vessels and a one-way valve between the vessels, where a first pressure vessel is coupled to the source and a last pressure vessel is coupled to the target. For one period of time, every other pressure vessel in the series is heated starting with the pressure vessel coupled to the source. As the pressure in the heated pressure vessels increases as a result of the heat, the gas is sent to a next pressure vessel in the series of pressure vessels. After some period of time, the other alternating sequence of pressure vessels is heated to move the gas along the series of pressure vessels from the source to the target.

Additional features of the present invention will become apparent from the following description and appended claims, taken in conjunction with the accompanying drawings.

DETAILED DESCRIPTION OF THE EMBODIMENTS

The following discussion of the embodiments of the invention directed to a thermal hydrogen compressor is merely exemplary in nature, and is in no way intended to limit the invention or its applications or uses. For example, the thermal hydrogen compressor can be used for other gases other than hydrogen and can be used for compressing hydrogen for other applications other than hydrogen storage for fuel cell vehicles.

As will be discussed in detail below, the present invention proposes a thermal hydrogen compressor that includes a series of pressure vessels that are cycled through heating and cooling steps so that the heating directs the hydrogen from a low pressure end of the series of pressure vessels to a high pressure end of the series of pressure vessels. At high temperature, the pressure increases, and the gas is pushed upstream through a one-way valve. At low temperatures, the pressure drops and the gas is drawn in through an inlet check valve to replace the gas that was transferred during the high temperature portion of the cycle.

In one embodiment, the first pressure vessel in the series is coupled to an electrolyzer that converts water to hydrogen gas and oxygen gas in a manner that is well understood in the art. As mentioned above, state of the art electrolyzers can produce the hydrogen gas at a pressure up to 13.5 MPa. Because most of the work has been done to raise the hydrogen pressure to 70 MPa by the electrolyzer by bringing the pressure to about 13.5 MPa, even a compression device with 5% efficiency could perform the boost compression from 13.5 MPa to 70 MPa using less than 11 kWh/kg. Boosting the pressure from 13.5 MPa to 70 MPa would only require 20% more energy than electrolyzing the hydrogen, even in a very low compression efficiency scenario. An efficiency as low as 3% could be acceptable if capital cost is very low.

Figure 1:
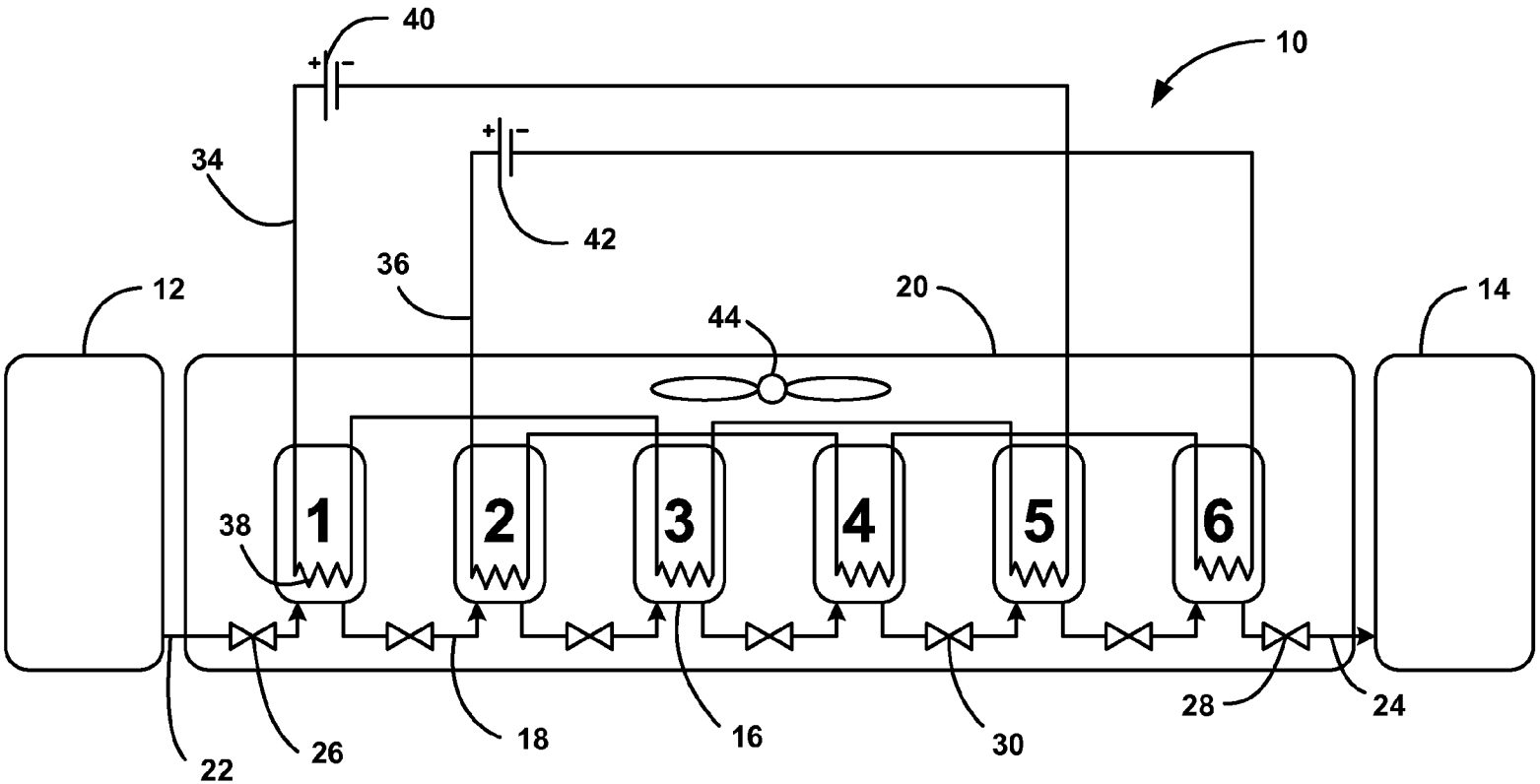
FIG. 1 is a schematic plan view of a thermal hydrogen compressor.

FIG. 1 is a schematic plan view of a thermal hydrogen compressor 10 that compresses a gas, such as hydrogen, provided by a source 12, such as an electrolyzer, to a target 14, such as a high pressure hydrogen tank on a vehicle. In this non-limiting embodiment, the source 12 may provide the hydrogen gas at a pressure of about 13.5 MPa and the compressor 10 may compress the hydrogen gas to a pressure of about 70 MPa for a fuel cell vehicle application. The compressor 10 includes a plurality of pressure vessels 16 coupled in series by pipes 18, where the pressure vessels 16 are provided in a suitable housing 20. In this non-limiting embodiment, there are six pressure vessels labeled 1-6. However, as will be appreciated by those skilled in the art, a different number of pressure vessels may be used for different designs depending on how fast the gas needs to be compressed, the size of the pressure vessels 16, the size of the source 12, etc.

Pressure vessel 1 is coupled to the source 12 by a pipe 22 and pressure vessel 6 is coupled to the tank 14 by a pipe 24. A one-way check valve 26 is provided in the pipe 22 and a one-way check valve 28 is provided in the pipe 24. Further, a one-way check valve 30 is provided in the pipes 18 between each of the pressure vessels 16, where the check valves 26, 28 and 30 are designed so that the gas is only able to flow through the series of pressure vessels 16 from the source end to the target end of the compressor 10. A higher pressure on an upstream side of a particular valve causes the valve to open and the gas to flow through the valve.

A heater loop 34 is provided to heat the gas in the pressure vessels 1, 3 and 5 and a heater loop 36 is provided to heat the gas in the pressure vessels 2, 4 and 6. In this non-limiting embodiment, the heater loops 34 and 36 are resistive type heaters that employ resistors 38 in the pressure vessels 16 to provide the heating. The heater loop 34 includes a power source 40 to provide electrical current to the resistors 38 and the heater loop 36 includes a power source 42 for providing electrical current to the resistors 38. The pressure vessels 16 may be cooled after being heated in a suitable manner, including liquid cooling, forced air cooling, convection, etc. A fan 44 is provided in the housing 20 as a cooler representing all of these various cooling devices and mechanisms.

Operation of the compressor 10 can be given as follows. During a heating cycle, the heater loop 34 is energized so that the gas in the pressure vessels 1, 3 and 5 is heated, which raises the pressure in those pressure vessels 16. The heater loop 36 is kept off during this portion of the cycle. As the gas is heated in the pressure vessels 1, 3 and 5 and the pressure increases, the check valve 30 downstream of the pressure vessels 1, 3 and 5 opens causing some amount of the gas in pressure vessel 1 to be sent to pressure vessel 2, some amount of the gas in pressure vessel 3 to be sent to pressure vessel 4 and some amount of the gas in pressure vessel 5 to be sent to pressure vessel 6.

After some period of time, the heater loop 34 is turned off allowing the pressure vessels 1, 3 and 5 to cool, which causes the pressure in the cooling pressure vessel to become lower than the upstream pressure vessel and causes the check valve 26 or 30 upstream of the cooling pressure vessel 16 to open, drawing gas into the pressure vessel 16 from the upstream higher pressure source. After a certain period of time has passed, the heater loop 36 is turned on, which causes the pressure vessels 2, 4 and 6 to heat, which causes the valve 28 or 30 down-stream of the heated pressure vessel to open and provides gas to the next pressure vessel 14 or 16 in the series, that is now cooled. The pressure vessel 6 provides the heated gas to be sent to the tank 14 through the valve 28. After some period of time, the heater loop 36 is turned off, allowing the pressure vessels 2, 4 and 6 to cool, which draws in gas from the upstream source, as described above. In this manner, lower pressure gas from the source 12 is transferred through the compressor 10 to the target tank 14. The various elements in the compressor 10 are calibrated so that the target tank can store hydrogen gas at a pressure up to 70 MPa.

Figure 2:
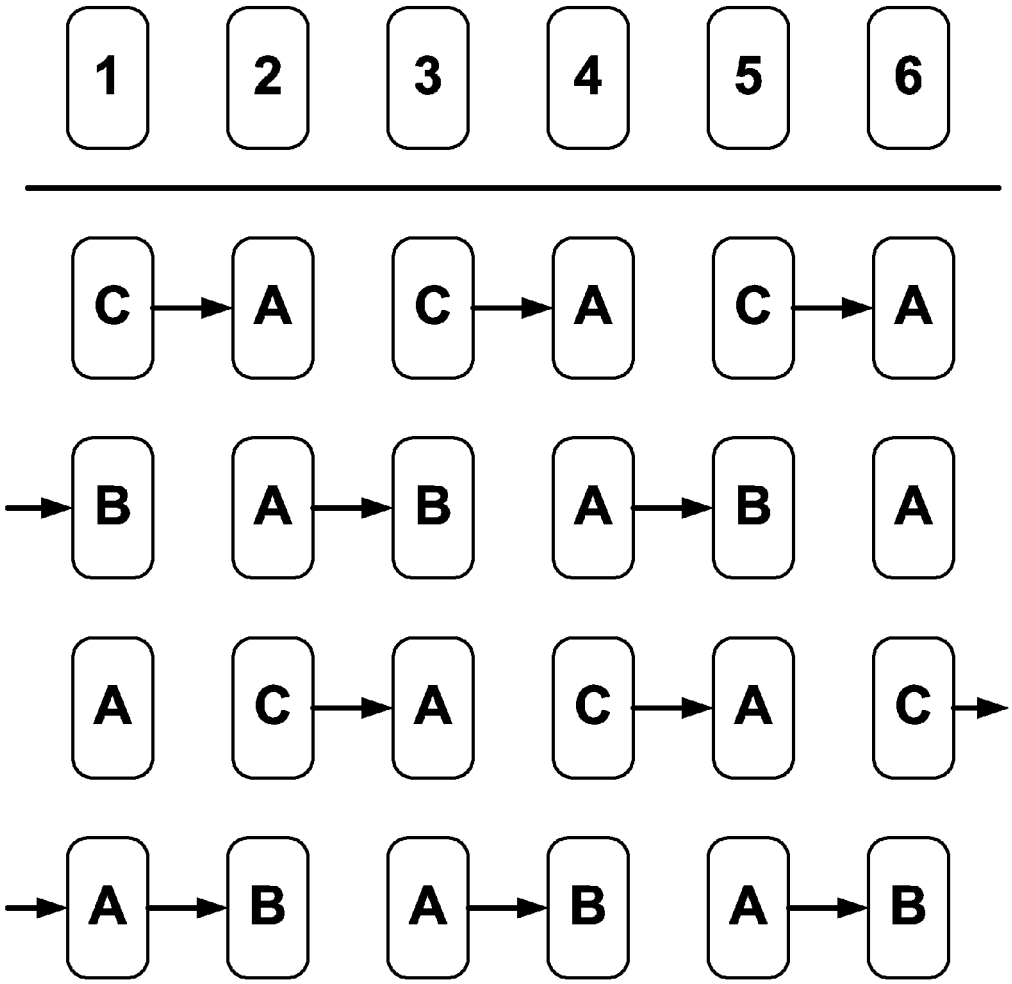
FIG. 2 is a representation of a plurality of pressure vessels in the compressor shown in FIG. 1 where some of the pressure vessels are designated as cool, some of the pressure vessels are designated as cooling and some of the pressure vessels are designated as hot to show the gas flow through the series of pressure vessels.

FIG. 2 is a representation of the operating sequence of the pressure vessels shown in the compressor 10. The top row of pressure vessels identifies the pressure vessel by number, where the four vessels below each pressure vessel are also the same numbered pressure vessel. The four pressure vessels below each numbered pressure vessel are labeled A for being cool, B for cooling, and C for being hot. The arrows represent the gas flow through the series of pressure vessels 16 as they are heated and cooled in the manner discussed above.

The foregoing discussion discloses and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. A gas compressor for compressing a gas provided by a source and delivering the compressed gas to a target, said compressor comprising:

a plurality of pressure vessels provided in a series, where a first one of the pressure vessels is fluidly coupled to the source and a last one of the pressure vessels is fluidly coupled to the target;

a plurality of one-way valves including a one-way valve in a gas line between the source and the first pressure vessel in the series, a one-way valve in a gas line between each of the pressure vessels and a one-way valve in a gas line between the last pressure vessel in the series and the target;

a first heater coupled to the first pressure vessel in the series and every other pressure vessel thereafter in the series; and a second heater coupled to the second pressure vessel in the series and every other pressure vessel thereafter, said first and second heaters being turned on to heat the gas in the pressure vessels in an alternating manner so as to draw the gas from the source and deliver it to the target at a higher pressure.

2. The compressor according to claim 1 wherein the source is an electrolyzer that converts water to oxygen gas and hydrogen gas where the compressor compresses the hydrogen gas.

3. The compressor according to claim 2 wherein the target is a high pressure tank.

4. The compressor according to claim 3 wherein the high pressure tank is on a vehicle and is part of a vehicle fuel cell system.

5. The compressor according to claim 2 wherein the electrolyzer provides hydrogen gas at a pressure of about 13.5 MPa and the last pressure vessel in the series provides hydrogen gas at a pressure of about 70 MPa.

6. The compressor according to claim 1 wherein the first heater and the second heater are resistive heaters.

7. The compressor according to claim 1 wherein the plurality of pressure vessels is six pressure vessels.

8. The compressor according to claim 1 wherein the compressor operates at an efficiency of 5% or less.

9. A hydrogen compressor for compressing a hydrogen gas provided by an electrolyzer and delivering the compressed gas to a high pressure gas tank for a fuel cell vehicle, said compressor comprising:

a plurality of pressure vessels provided in a series, where a first one of the pressure vessels is fluidly coupled to the source and a last one of the pressure vessels is fluidly coupled to the high pressure tank;

a plurality of one-way check valves including a one-way valve in a gas line between the electrolyzer and the first pressure vessel in the series, a one-way valve between each of the pressure vessels in the series and a one-way valve in a gas line between the last pressure vessel in a series and the high pressure tank;

a first resistive heater coupled to the first pressure vessel in the series and every other pressure vessel thereafter in the series; and a second resistive heater coupled to the second pressure vessel in the series and every alternating pressure vessel thereafter in the series, said first and second heaters being alternately turned on to heat the hydrogen gas in the pressure vessels so as to draw the hydrogen gas from the electrolyzer and deliver it to the high pressure tank at a higher pressure.

10. The compressor according to claim 9 wherein the electrolyzer provides hydrogen gas at a pressure of about 13.5 MPa and the last pressure vessel in the series provides hydrogen gas at a pressure of about 70 MPa.

11. The compressor according to claim 9 wherein the plurality of pressure vessels is six pressure vessels.

12. The compressor according to claim 9 wherein the compressor operates at an efficiency of 5% or less.

13. A gas compressor for compressing a gas provided by a source and delivering the compressed gas to a target, said compressor comprising:

a plurality of pressure vessels provided in a series, where a first one of the pressure vessels is fluidly coupled to the source and a last one of the pressure vessels is fluidly coupled to the target;

a plurality of one-way valves including a one-way valve in a gas line between the source and the first pressure vessel in the series, a one-way valve in a gas line between each of the pressure vessels and a one-way valve in a gas line between the last pressure vessel in the series and the target; and a heating system that selectively heats the pressure vessels so that the gas in the pressure vessels is heated and cooled in a manner that draws the gas from the source and delivers it to the target at a higher pressure, including a first phase where the first pressure vessel in the series and every other pressure vessel thereafter is hot and the second pressure vessel in the series and every other pressure vessel thereafter is cold, a second phase where the first pressure vessel in the series and every other pressure vessel thereafter is cooling and the second pressure vessel in the series and every other pressure vessel thereafter is cold, a third phase where the first pressure vessel in the series and every other pressure vessel thereafter is cold and the second pressure vessel in the series and every other pressure vessel thereafter is hot, and a fourth phase where the first pressure vessel in the series and every other pressure vessel thereafter is cold and the second pressure vessel in the series and every other pressure vessel thereafter is cooling.

14. The compressor according to claim 13 wherein the source is an electrolyzer that converts water to oxygen gas and hydrogen gas where the compressor compresses the hydrogen gas.

15. The compressor according to claim 14 wherein the target is a high pressure tank.

16. The compressor according to claim 15 wherein the high pressure tank is on a vehicle and is part of a vehicle fuel cell system.

17. The compressor according to claim 14 wherein the electrolyzer provides hydrogen gas at a pressure of about 13.5 MPa and the last pressure vessel in the series provides hydrogen gas at a pressure of about 70 MPa.

18. The compressor according to claim 13 wherein the heating system includes resistive heaters.

19. The compressor according to claim 13 wherein the plurality of pressure vessels is six pressure vessels.

20. The compressor according to claim 13 wherein the compressor operates at an efficiency of 5% or less.

* * * * *